US005450178A

United States Patent [19]

Kawashima et al.

[11] Patent Number: 5,450,178

[45] Date of Patent: Sep. 12, 1995

[54] PROCESS AND APPARATUS FOR REPLACING THE CARRIER PORTION OF A DEVELOPING AGENT HAVING TONER USED IN AN IMAGE-FORMING APPARATUS

[75] Inventors: Masato Kawashima, Kawasaki; Mamoru Watanabe, Fuchu; Masanao Nagakura, Akigawa; Hideyuki Nanba, Kawasaki, all of Japan

[73] Assignee: Fujitsu Limited, Kawasaki, Japan

[21] Appl. No.: 364,419

[22] Filed: Dec. 27, 1994

Related U.S. Application Data

[63] Continuation of Ser. No. 91,730, Jul. 15, 1993, abandoned, which is a continuation of Ser. No. 756,682, Sep. 9, 1991, abandoned.

[30] Foreign Application Priority Data

Sep. 10, 1990 [JP] Japan ..... 2-236992
Nov. 30, 1990 [JP] Japan ..... 2-334162

[51] Int. Cl.[6] ..... G03G 15/06
[52] U.S. Cl. ..... 355/260; 355/246
[58] Field of Search ..... 355/208, 245, 246, 260; 118/653; 272/DIG. 1

[56] References Cited

U.S. PATENT DOCUMENTS

| | | | |
|---|---|---|---|
| 3,954,331 | 5/1976 | Smith | 118/637 X |
| 4,354,763 | 10/1982 | Koiso et al. | 366/181 |
| 4,601,259 | 7/1986 | Yamashita | 118/658 |
| 5,005,517 | 4/1991 | Fukui et al. | 118/689 |
| 5,028,961 | 7/1991 | De Cecca | 355/260 |
| 5,073,468 | 12/1991 | Yamamoto et al. | 430/110 |
| 5,107,302 | 4/1992 | Bisaiji | 355/246 |
| 5,109,254 | 4/1992 | Oka et al. | 355/260 |
| 5,119,758 | 6/1992 | Inoue et al. | 118/658 |
| 5,185,631 | 2/1993 | Shibata | 355/245 |
| 5,235,384 | 8/1993 | Oka et al. | 355/208 |
| 5,289,241 | 2/1994 | Sugiyama et al. | 355/260 |

*Primary Examiner*—Leo P. Picard
*Assistant Examiner*—Christopher Horgan
*Attorney, Agent, or Firm*—Armstrong, Westerman, Hattori, McLeland and Naughton

[57] ABSTRACT

In an image-forming apparatus, in which an electrostatic latent image on a photoconductive drum is developed by a toner accommodated in a container, a periodical exchange of carrier in a container is necessary. A method thereof includes steps of fitting a cartridge to the container, discharging all of an old mixture of toner and carrier from the container to the lower chamber, transferring fresh carrier from the carrier compartment into the container, and further, transferring fresh toner from the toner compartment into the container until a predetermined initial color density of the mixture is obtained.

36 Claims, 11 Drawing Sheets

PROCESS AND APPARATUS FOR REPLACING THE CARRIER PORTION OF A DEVELOPING AGENT HAVING TONER USED IN AN IMAGE-FORMING APPARATUS

This application is a continuation of application Ser. No. 08/091,730 filed Jul. 15, 1993, now abandoned; which is a continuation of application Ser. No. 07/756,682, filed Sep. 9, 1991, now abandoned.

BACKGROUND OF THE INVENTION

1. Field of the Invention

The present invention relates to an image-forming apparatus, particularly one used for a dry type electrophotography. More specifically, it relates to a process for exchanging a developing agent in the above type image-forming apparatus, and a device for carrying out such a process.

2. Description of the Related Arts

In an image-forming apparatus used for dry type electrophotography, an electrostatic image is formed on a photoconductive drum, developed by a developing agent delivered from a developer unit, and transferred onto a paper, and the image on the paper is fixed thereto by a fuser unit.

The developing agent usually consists of two components; a carrier formed of a ferrite powder easily attracted to a magnetic roll, and a toner formed of a synthetic resin, such as a polyester resin or a polyacrylic resin, which can be carried by the carrier to the photoconductive drum and attached thereto. Upon formation of the developed image on the photoconductive drum, and the transfer thereof to the paper, the toner is exhausted but the carrier is returned to a powder container in a developer unit for reuse.

As the toner is expendable, a toner cartridge is inserted in the developer unit, from which the toner is transferred into the container by a feed roller and mixed with the carrier therein by a mixing screw, while being controlled in such a manner that the color density of the toner mixture monitored by a sensor is maintained at a predetermined level.

Although the carrier is not expendable, in principle, it should be periodically replaced because the surface state of the carrier powder initially imparted thereto deteriorates as a result of long term use, which causes a lowered color density or a fogging of a fixed image.

In the prior art, the carrier replacement is carried out by discharging all of the old carrier from the container and filling fresh carrier therein. This replacement includes a complicated operation for the detaching of container from the developer unit, for which expert service personnel are required.

SUMMARY OF THE INVENTION

An object of the present invention is to provide a method of exchanging a developing agent including a carrier in an image-forming apparatus, which can be easily carried out without the assistance of expert service personnel.

Another object of the present invention is to provide a device suitable for carrying out the exchanging process.

The above object is achieved by a method according to the present invention of exchanging the carrier in a container, comprising the steps of: fitting a cartridge, comprising an upper and a lower chamber, the upper chamber being formed by a toner compartment in which a fresh toner is reserved and a carrier compartment in which a fresh carrier is reserved, to the container so that the container is sandwiched between the upper and lower chambers; discharging all of an old mixture of toner and carrier from the container to the lower chamber; transferring the fresh carrier from the carrier compartment into the container; and transferring the fresh toner from the toner compartment into the container until a predetermined initial color density of the mixture in the container is obtained.

According to another aspect of the present invention, a method is provided of exchanging the carrier in a container, comprising the steps of: fitting a cartridge comprising upper and lower chamber, the upper chamber being formed by a toner compartment in which a fresh toner is reserved and a mixture compartment in which a fresh mixture of toner and carrier is reserved, to the container so that the container is sandwiched between the upper and lower chambers; discharging part of an old mixture of toner and carrier from the container; replenishing an amount of fresh toner from the toner compartment into the container until a predetermined initial color density of the mixture in the container is obtained; and transferring part of the fresh mixture of toner and carrier, corresponding to the discharged amount of the old mixture, from the mixture compartment into the container.

According to further aspect of the present invention, a method of exchanging the carrier in a container, comprising the steps of: fitting a cartridge, comprising upper and lower chamber, the upper chamber reserving a fresh mixture of toner and carrier prepared so that the toner content is higher than that in daily use, to the container so that the container is sandwiched between the upper and lower chambers; transferring an amount of the fresh mixture from the upper chamber into the container until a predetermined initial color density of the mixture in the container is obtained; and discharging part of an old mixture of toner and carrier corresponding to the transferred amount of the fresh mixture from the container.

According to a still further aspect of the present invention, a shutter mechanism used for carrying out the method defined by the first aspect is provided, comprising an upper shutter movable between a closed position at which an interior of the container is shut off from the carrier compartment of the upper chamber of the cartridge and an open position at which an interior of the container is communicated with the carrier compartment; and a lower shutter movable between a closed position at which an interior of the container is shut off from the lower chamber of the cartridge and an open position at which an interior of the container is communicated with the lower chamber; the upper and lower shutters being associated with each other through a cam system in such a manner that the upper and lower shutters occupy the open position at an angular cam phase of 180° different from each other.

BRIEF DESCRIPTION OF THE DRAWINGS

These and other objects and advantages of the present invention will be more apparent from the following description with reference to the drawings illustrating the preferred embodiments of the present invention: wherein.

DESCRIPTION OF THE PREFERRED EMBODIMENTS

Figure 1:
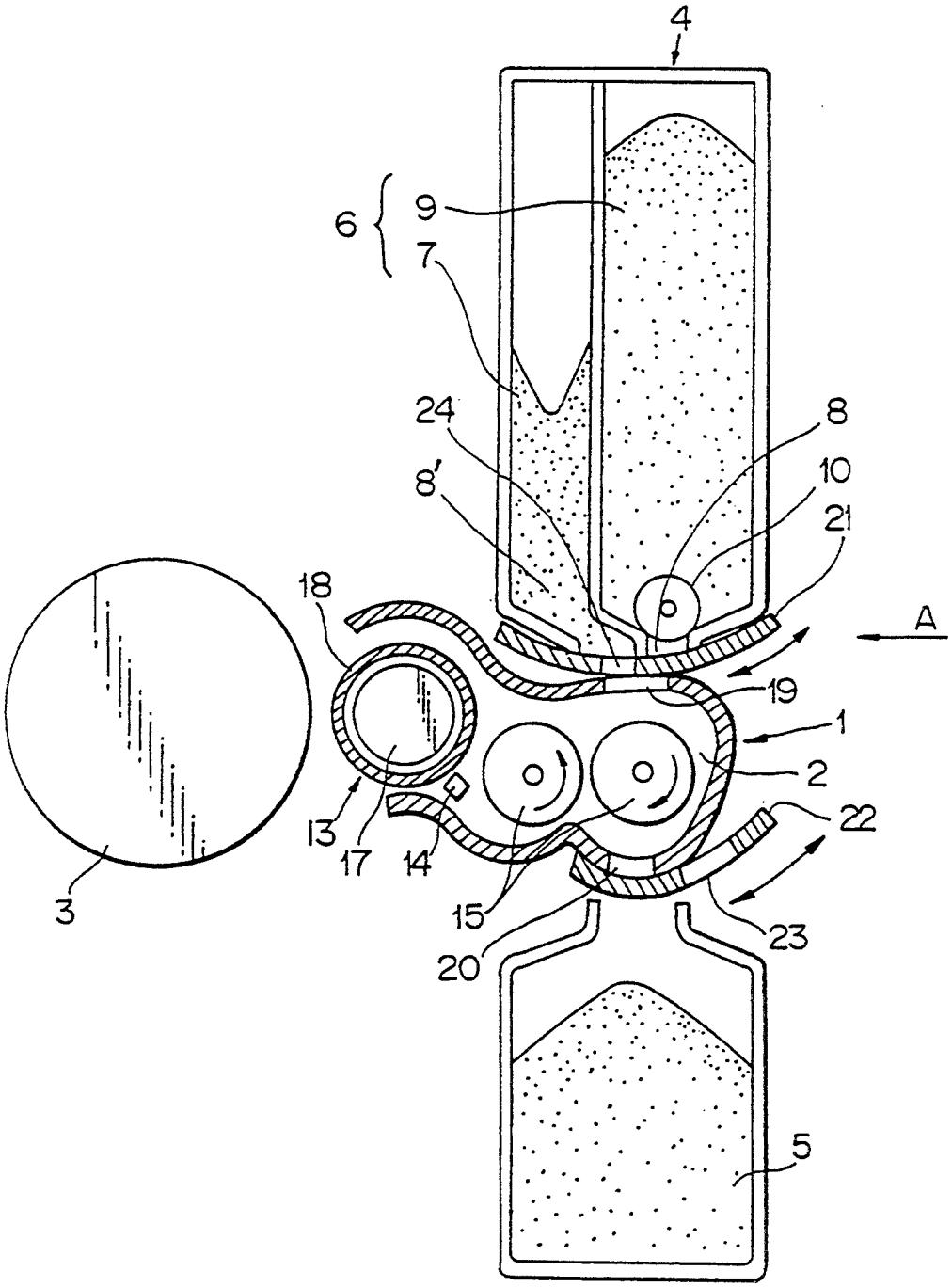
FIG. 1 is a schematic side sectional view of a first embodiment of a device for exchanging a developing agent in an image-forming apparatus, according to the present invention.
Figure 2:
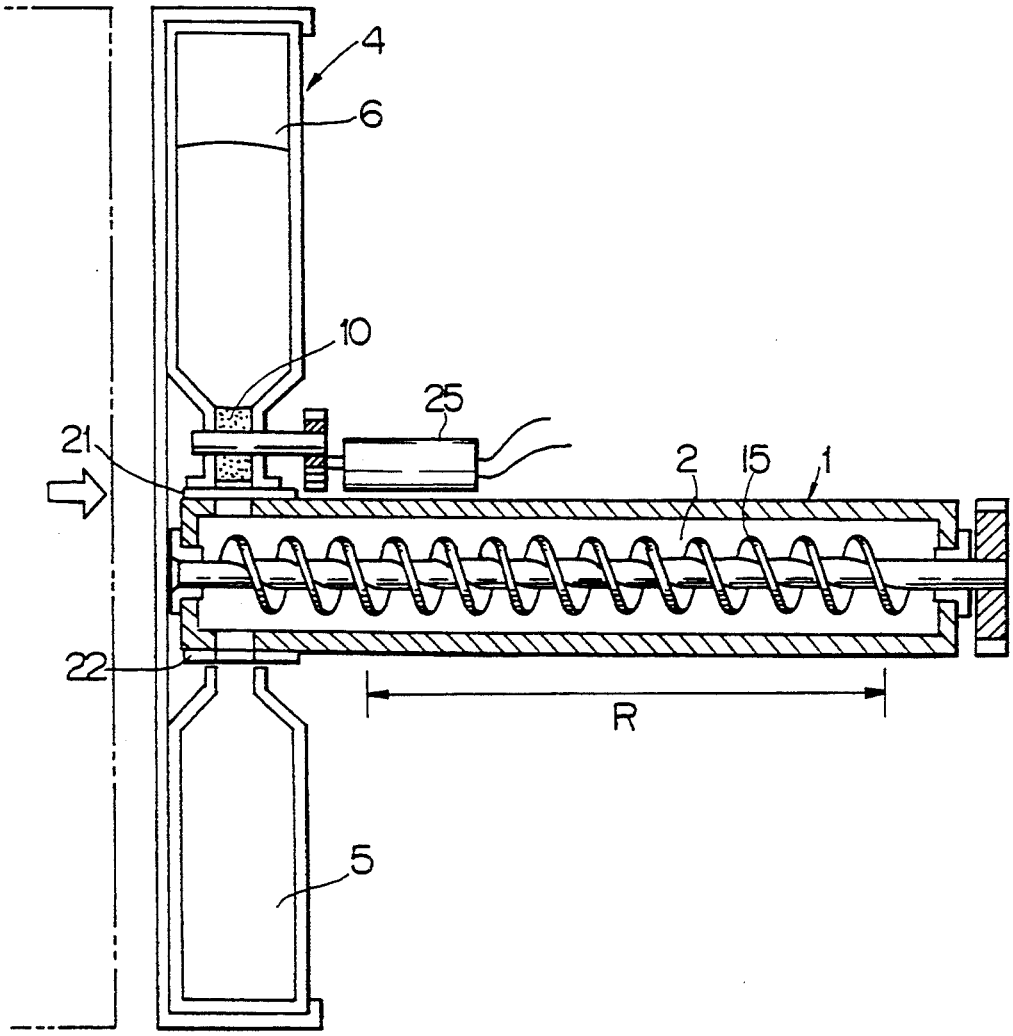
FIG. 2 is a view seen in the direction shown in arrow A of FIG. 1.

In a first embodiment shown in FIGS. 1 and 2, a developer unit 1 comprises a container 2 accommodating a developing agent. The container 2 has a magnet roller 13 at a front opening thereof, comprising a stationary magnet roll 17 and an aluminum sleeve 18 rotatably mounted on the periphery of the magnet roll 17. A carrier powder carrying a toner in the developing agent thereon is attracted onto the periphery of the aluminum sleeve 18 and the toner is transferred onto the photoconductive drum 3. An inlet port 19 for introducing the developing agent to the interior of the container 2 is provided in the upper wall of the container 2, and similarly, an exit port 20 for discharging the developing agent from the interior of the container 2 is formed. Shutters 21 and 22 are provided for closing/opening these ports 20, 21, and a pair of screws 15, 15, each driven by a drive means such as a motor (not shown to rotate in directions opposite to the other, are arranged within the container 2 for mixing the toner with the carrier so that the former receives a sufficiently electrostatic charge.

When a replacement of developing agent in the container 2 is required due to a deterioration of the carrier powder caused by long term use, a cartridge 4, consisting of an upper chamber 6 for accommodating a fresh developing agent to be supplied in the container 2 and a lower chamber 5 for collecting an old developing agent from the container 2, is fitted to the container 2 at a position corresponding to the inlet port 19 and the exit port 20, while sandwiching the container 2 between the two lower and upper chambers 5, 6. More specifically, the cartridge 4 is positioned, as illustrated in FIG. 2, laterally away from the working zone R of the image-forming apparatus (i.e., the area confronting the photoconductive drum 3). The upper chamber 6 is divided into two compartments, a toner compartment 9 and a carrier compartment 7, and the bottom walls these respective compartments 7, 9 are provided with orifices 8 and 8' confronting the inlet port 19, for replenishing the content thereof into the interior of the container 2 through the inlet port 19. Within the toner compartment 9 and above the orifice 8 is provided a replenishing roller 10 made of sponge, for adjusting an amount of toner to be replenished to the container 2.

According to this embodiment, the replacement of the mixture powder of developing agent in the container 2 is carried out as follows:

The lower shutter 22 is actuated to slide on the left side in FIG. 1 after the cartridge 4 has been fitted to the developer unit 1,and aperture 23 of the shutter 22 is aligned with the exit port 20 of the container 2, whereby the old developing agent in the container 2 is removed therefrom and collected into the lower chamber 5 through the exit port 20 and the aperture 23 aligned with each other. Simultaneously, the mixing screws 15 are driven so that the developing agent in the container 2 is continuously conveyed near to the exit port 20, to thereby accelerate the removal operation.

After all of the old developing agent in the container 2 has been collected in the lower chamber 5, the lower shutter 22 resumes its original position and closes the exit port 20, and then the upper shutter 21 is actuated to slide to the position shown in FIG. 1 where an aperture 24 provided in the upper shutter 21 is aligned with the orifice 8' formed in the bottom wall of the carrier compartment 7. Accordingly, the interior of the carrier compartment 7 is communicated with that of the container 2 through the inlet port 19 of the container 2. Note the orifice 8 in the toner compartment 9 is still closed by the upper shutter 21 at this stage. Therefore, the carrier in the carrier compartment 7 is transferred to the container 2 through the aligned openings 8', 24 and 19.

After the reserved fresh carrier has been supplied to the container 2, the upper shutter 21 is further actuated to close the orifice 8' of the carrier compartment 7 and open the orifice 8 of the toner compartment 9, by aligning the orifice 8' with the aperture 24 of the shutter 21. Then the replenishing roller 10 is made to rotate by a motor 25 shown in FIG. 2, and accordingly, the toner ill the toner compartment 9 is supplied to the interior of the container 2. During this operation, the rotation of the replenishing roller 10 is controlled by a signal output from a sensor 14 for monitoring a color density of the developing agent in the container, the rotation of the roller 10 is stopped when the color density reaches a predetermined level, and thus the transfer to and preparation of a fresh mixture of developing agent in the container 2 is completed.

The cartridge 4 having the upper chamber with two compartments as stated above is replaced by another cartridge comprising only a single compartment for toner 9, after the above replacement of the developing agent mixture in the container has been completed, and the reserved toner is transferred therefrom into the container 2 during the daily use of the image-forming apparatus, whenever a signal indicating a lowering of the color density of the mixture of developing agent is output from the sensor 14, which corresponds to an exhausting of the toner component in the mixture. This is because the life span of the carrier is much longer than the exhausted period of the toner, and because the carrier is relatively expensive.

Figure 3:
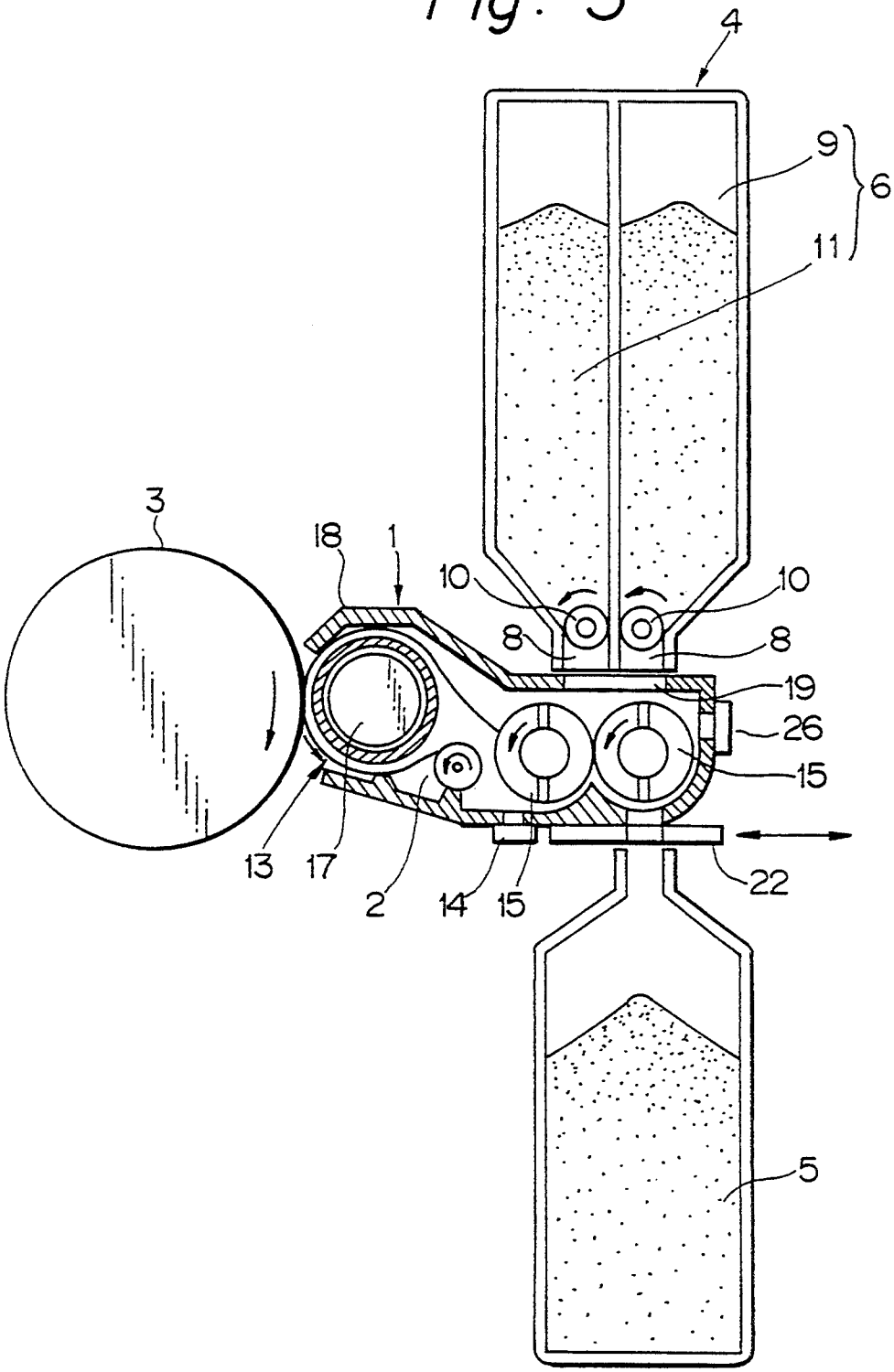
FIG. 3 is a view similar to FIG. 1 and showing a second embodiment of the present invention.

A second embodiment of the present invention is illustrated in FIG. 3, in which similar parts are designated by the same reference numerals as used in FIG. 1.

This embodiment is used for gradually replacing part of the mixture powder in the container 2 during daily use, to thereby avoid a sudden change in the quality of the developing agent.

An upper chamber 6 of a cartridge 4 is divided into two compartments 9 and 11. A toner is accommodated in the compartment 9 and a mixture of toner and carrier is accommodated in the other compartment 11. Orifices 8, 8' provided with the respective replenishing rollers 10, 10 are arranged in the respective compartments 9, 11 so that they confront a common inlet port 19 formed in the top wall of the compartment 2.

According to this embodiment, when a replacement of the mixture powder in the container 2 is required, first a lower shutter 22 normally closing for a predetermined time, to open the exit port 20 as illustrated, whereby part of the old developing agent is discharged from the container 2 and collected in a lower chamber 5 of the cartridge 4. After the shutter 22 has resumed its original position, the replenishing roller 10 in the compartment 9 is rotated to feed the toner into the container 2 in response to the signal output from a sensor 14 when detecting a change in the color density of the mixture of developing agent in the container 2 due to toner exhaustion. Simultaneously therewith, the replenishing roller 10 on the mixture compartment 11 is also rotated to feed the fresh mixture reserved therein into the container 2. The amounts of replenished mixture is controlled so that the content in the container 2 is kept to a constant value by a signal output from a sensor 26 for detecting an amount of the mixture in the container 2.

Until the next replacement operation is started, only the transfer of fresh toner reserved in the toner compartment 9 to the container 2 is repeated as the toner in the mixture therein is exhausted.

Figure 4:
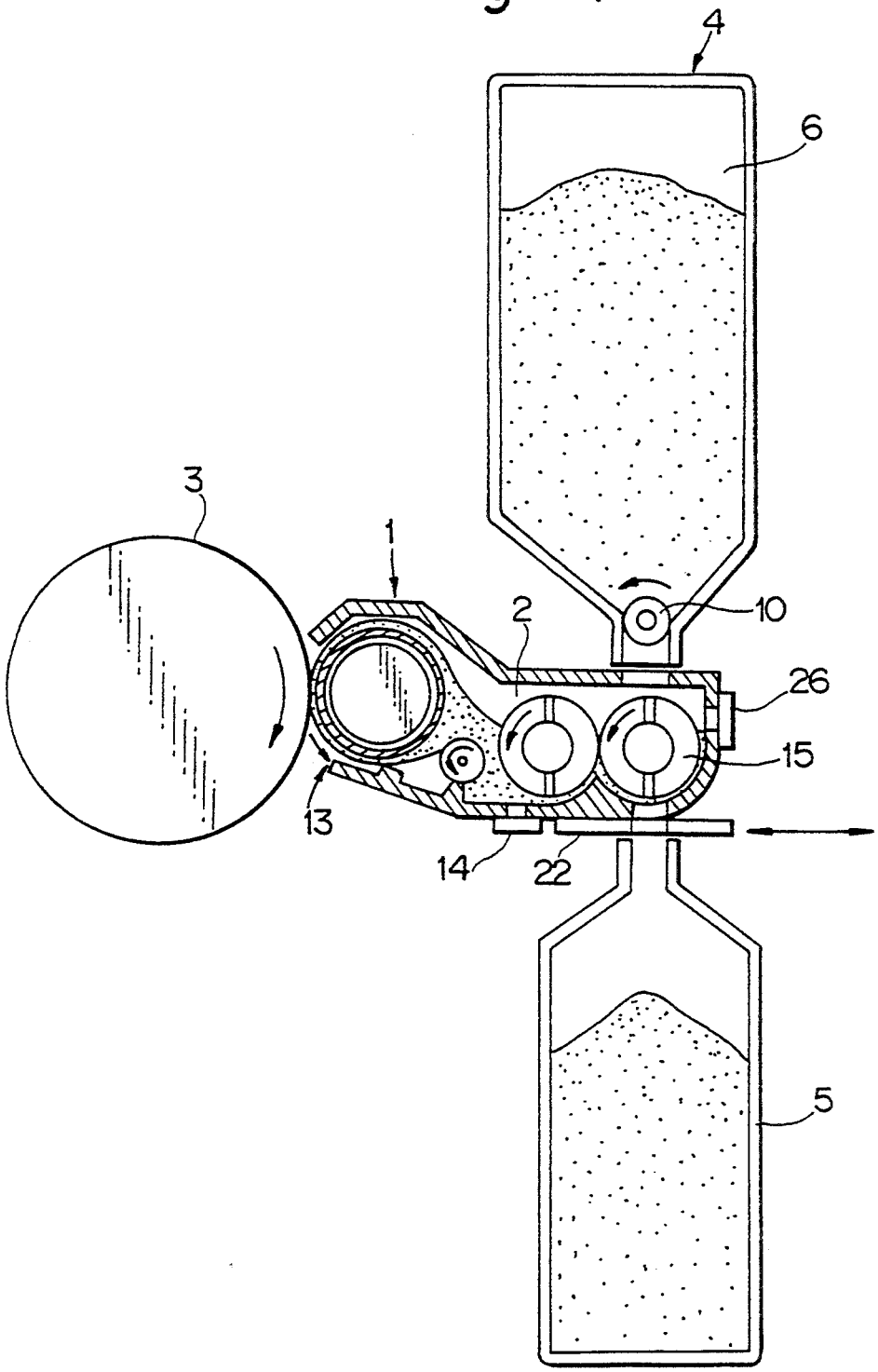
FIG. 4 is a view similar to FIG. 1 and showing a third embodiment of the present invention.

A third embodiment is illustrated in FIG. 4, in which an upper chamber 6 of a cartridge 4 is formed by a single compartment accommodating a mixture powder of toner and carrier. A content of toner in this reserved mixture is higher, for example, more than 20%, than that of the mixture for daily use. The reserved mixture of developing agent is gradually transferred into the container 2 by the action of a replenishing roller 10, and part of the old mixture in the container 2 is discharged therefrom into a lower chamber 5 by the action of a lower shutter 22 controlled by a signal output by a sensor 26 for detecting an amount of developing agent in the container 2, so that the total amount of the mixture in the container 2 is maintained at a constant value.

Figure 5:
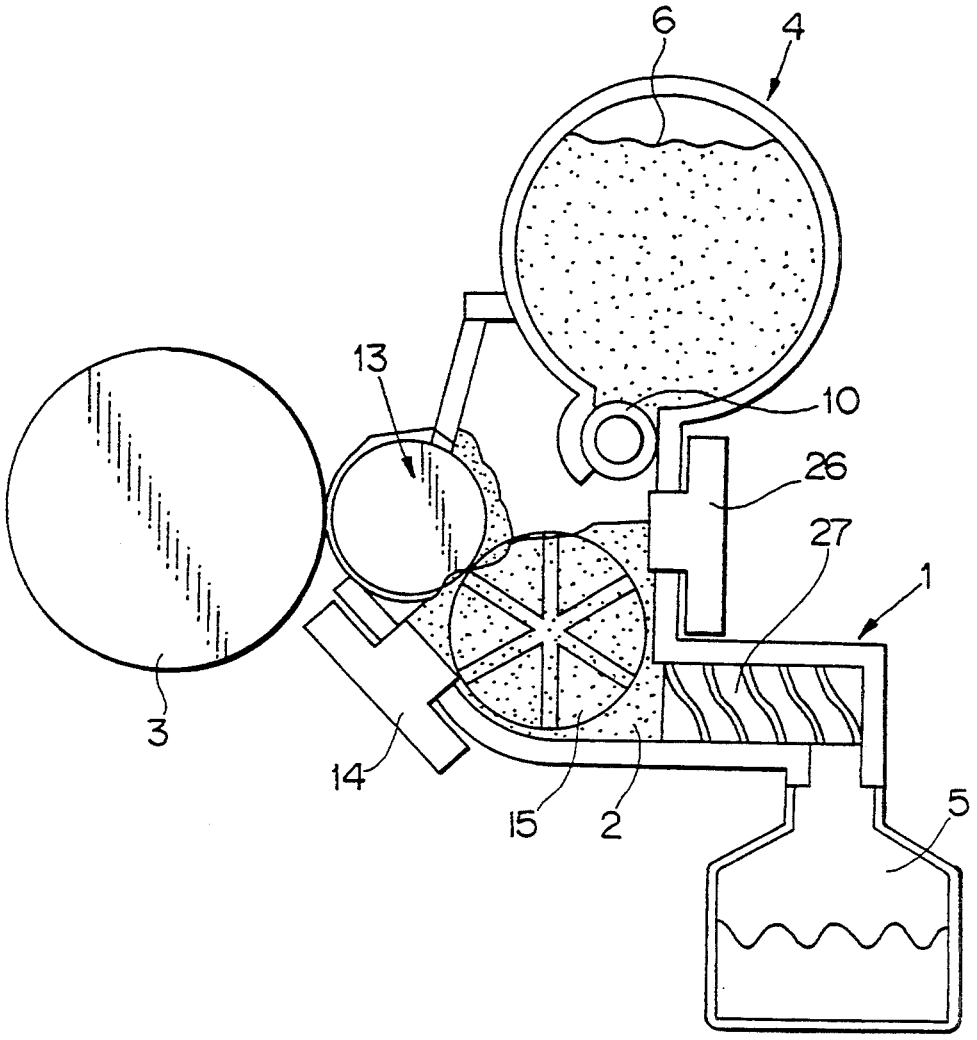
FIG. 5 illustrates a variant of the third embodiment of FIG. 4.
Figure 6:
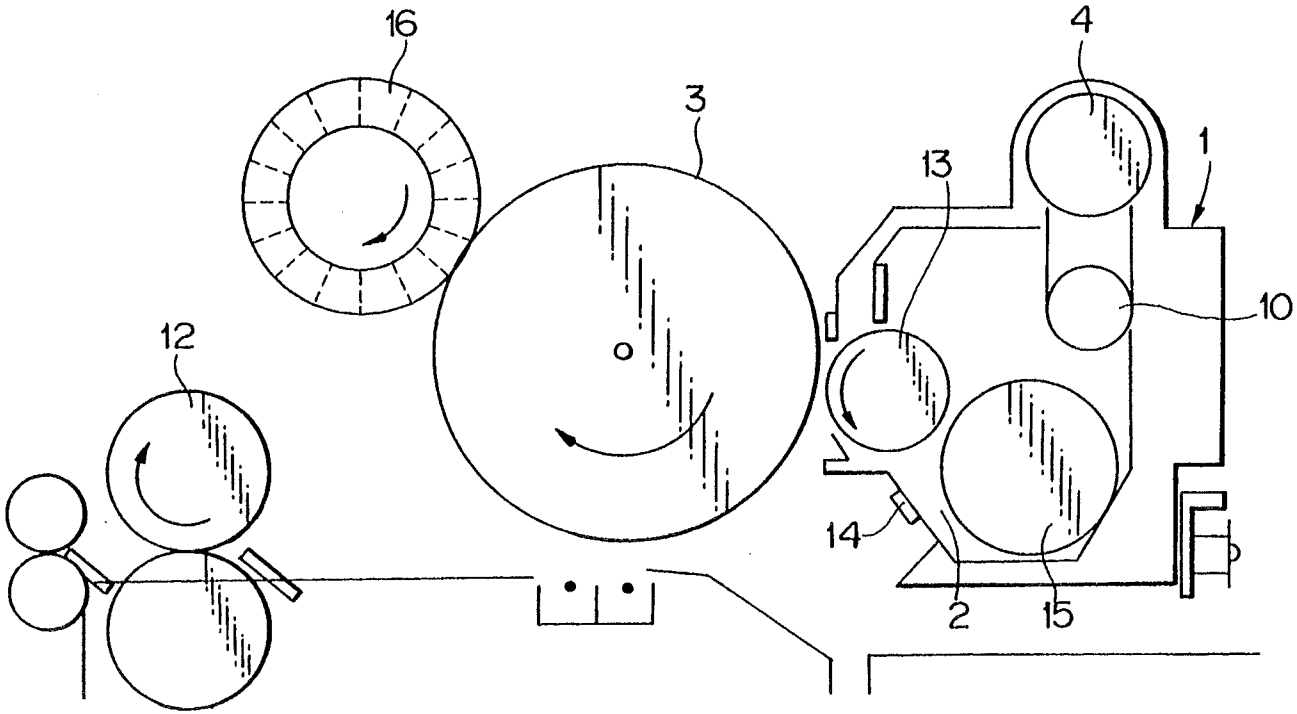
FIG. 6 is a schematic side sectional view of the conventional image-forming apparatus of a dry type electrophotography.

As shown in FIG. 5, a screw 27 may be provided in the container 2 for enhancing the discharge of the old developing agent.

FIGS. 7 through 12 illustrate a preferable mechanism for actuating the upper and lower shutters in the first embodiment already described with reference to FIG. 1, for transferring a fresh carrier from an upper chamber 6 of a cartridge 4 into a container 2 and discharging an old mixture of developing agent from the container 2 into a lower chamber 5 of the cartridge 4. In the first embodiment, the upper and lower shutters 21, 22 must be actuated in association with each other.

Figure 7:
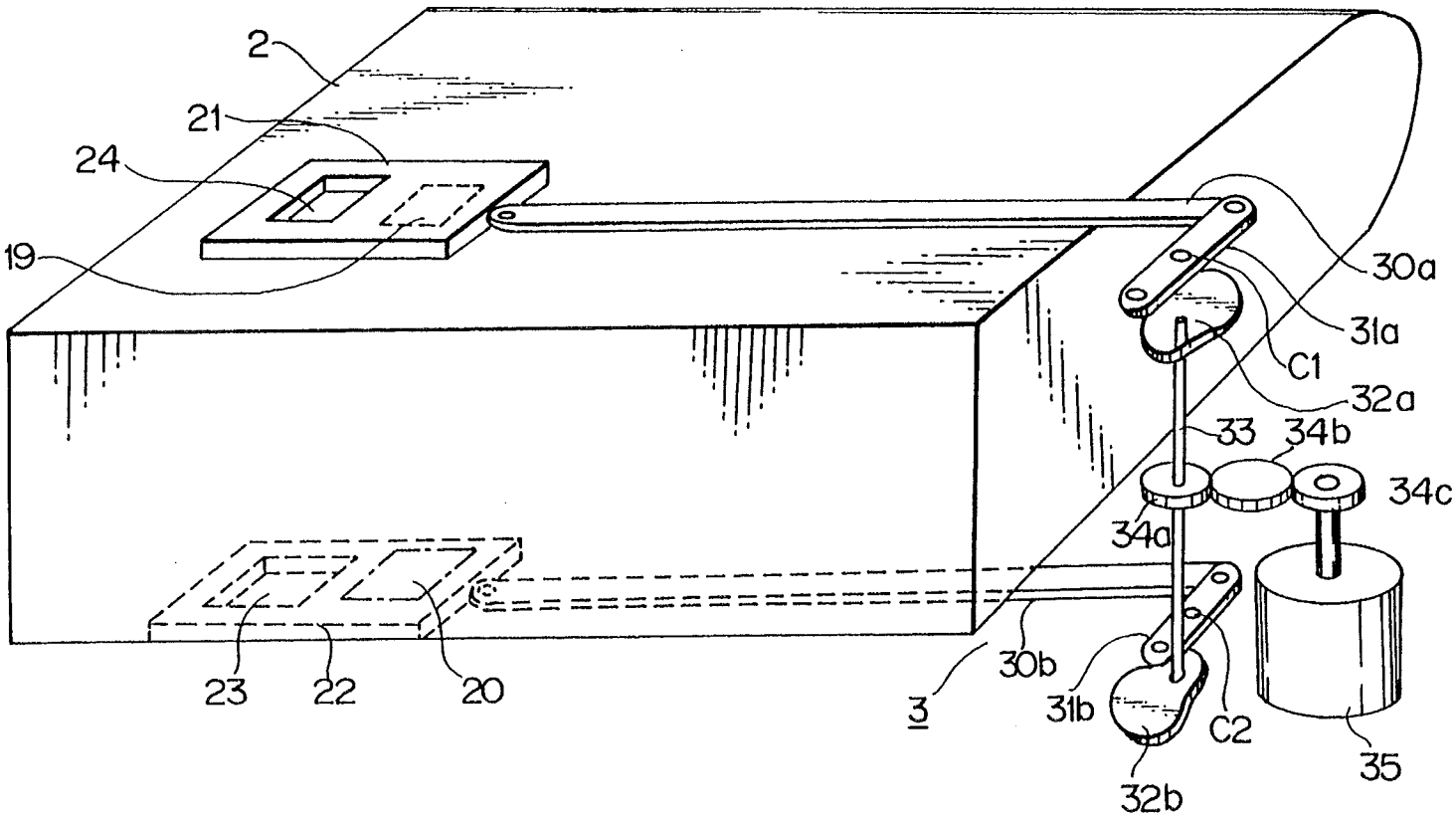
FIG. 7 is a schematic illustration of a mechanism for driving shutters.

A diagrammatic view of this mechanism is illustrated in FIG. 7, in which a container 2 in which a developer unit is accommodated has an inlet port 19 for introducing a toner powder or a carrier powder reserved in an upper chamber of a cartridge (not shown in FIG. 7) and an exit port 20 for discharging an old mixture of developing agent from the container 2 and collecting the same into a lower chamber (not shown in FIG. 7), as described before.

Upper and lower shutters 21 and 22 are provided for closing and opening the ports 19 and 20, and a motor 35 is provided to drive the shutters 21. 22. The rotation of the motor 35 is transmitted through a gear train 34*a*, 34*b* and 34*c* to a vertical shaft 33, at the respective ends of which are fixed a pair of upper and lower cams 32*a* and 32*b* at an angular phase different from each other by 180°.

The upper cam 32*a* drives a first lever 31*a*, which in turn drives a second lever 30*a* linked to the first lever 31*a* at one end and connected to the upper shutter 21 at the other end, and thus the upper shutter 21 is actuated in the lengthwise direction of the second lever 30*a*. Similarly, the lower cam 32*b* drives the lower shutter 22 through a first lever 31*b* and a second lever 31*a*.

Figure 8:
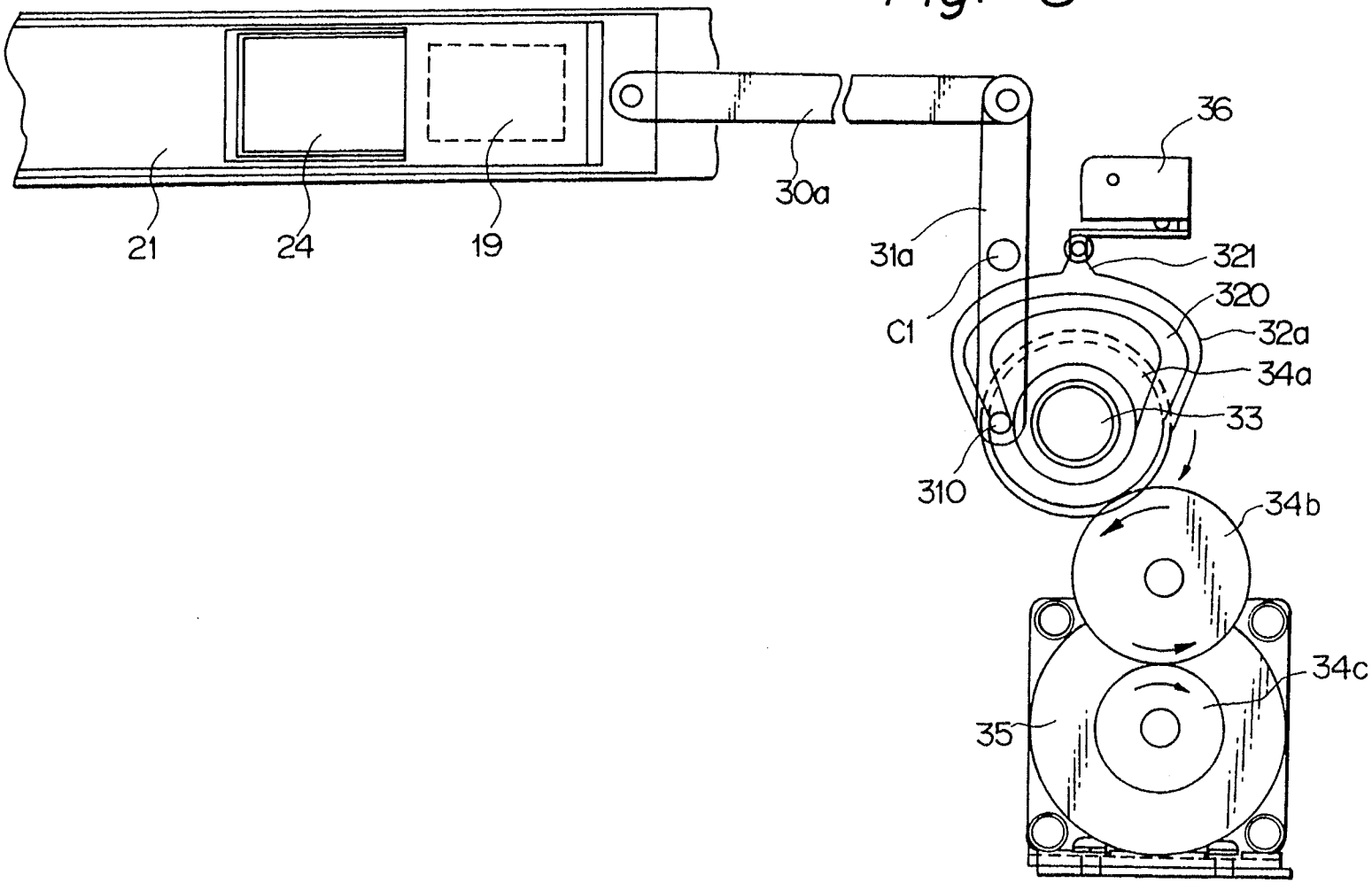
FIGS. 8 and 9 are a plan view of a cam/link system for operating the upper and lower shutters, respectively.

The above structure of cam and levers is more specifically shown in FIG. 8. The cam 32*a* has a home-position lug 321 and a cam groove 320 with a profile having a semicircular portion with a smaller diameter and an arcuate portion with a larger diameter smoothly connected to the former. A cam follower 310 secured at a free end of the first lever 31*a* is engaged with the cam groove 320. When the cam 32*a* rotates, the first lever 31*b* is driven to pivot about a stationary pin C1 and the second lever 30*a* linked to a free end of the first lever 31*a* is linearly pushed or pulled by the first lever 31*a* so that the upper shutter 15 connected to the second lever 31*a* slides along a guide 10*a*, for transferring the fresh developing agent reserved in the upper chamber of the cartridge.

A micro-switch 36 arranged at a fixed position in the vicinity of a cam surface detects a home-position of the cam 32*a* in association with the home-position lug 32*a*.

Figure 9:
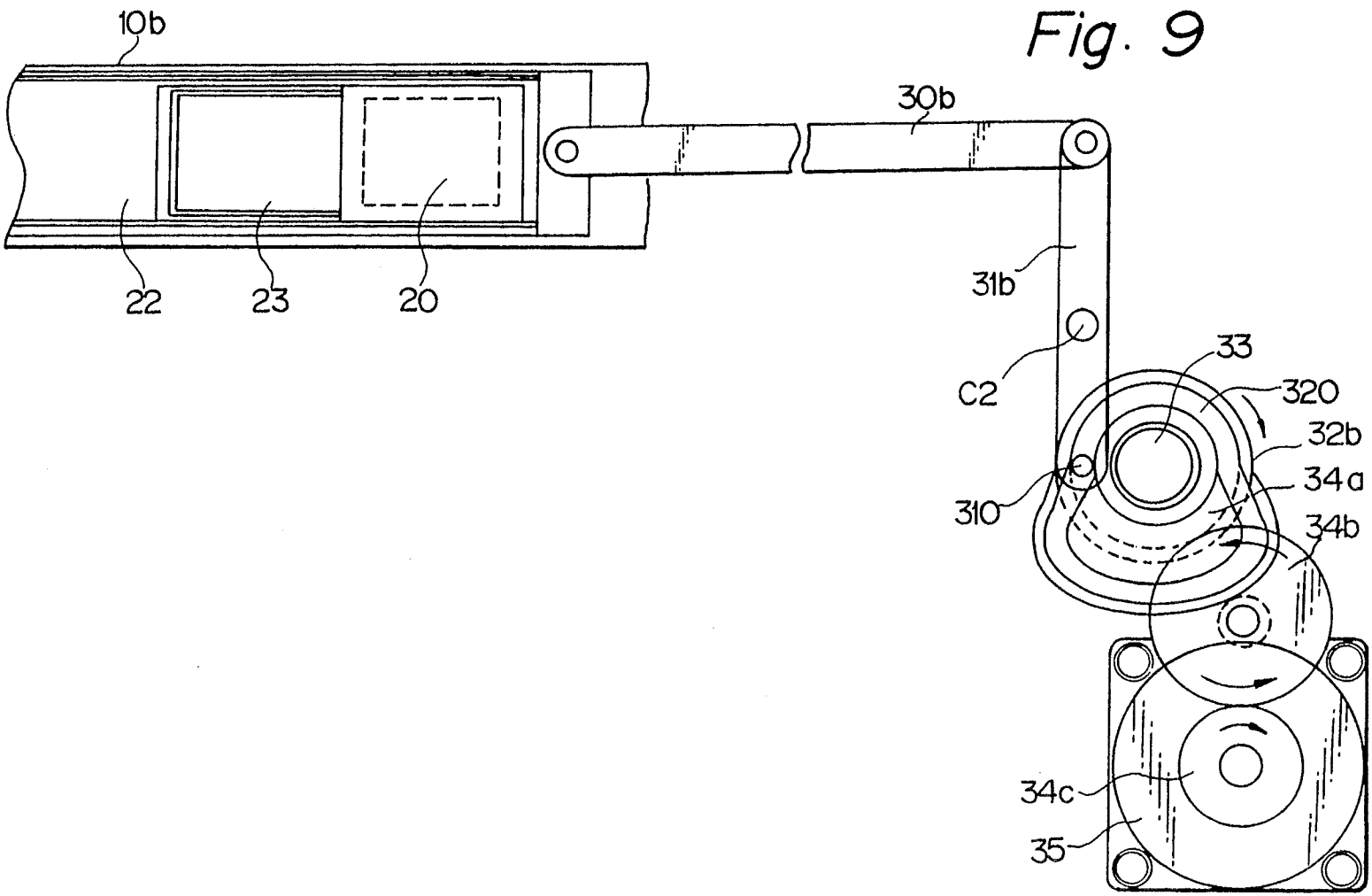

For discharging the old developing agent in the container 2, the lower shutter 22 is driven by the cam 32*b* through a link mechanism shown in FIG. 9, the operation of which is exactly the same as stated above, except that the angular phases of cams 32*a*, 32*b* are different from each other by 180°.

Figure 10A:
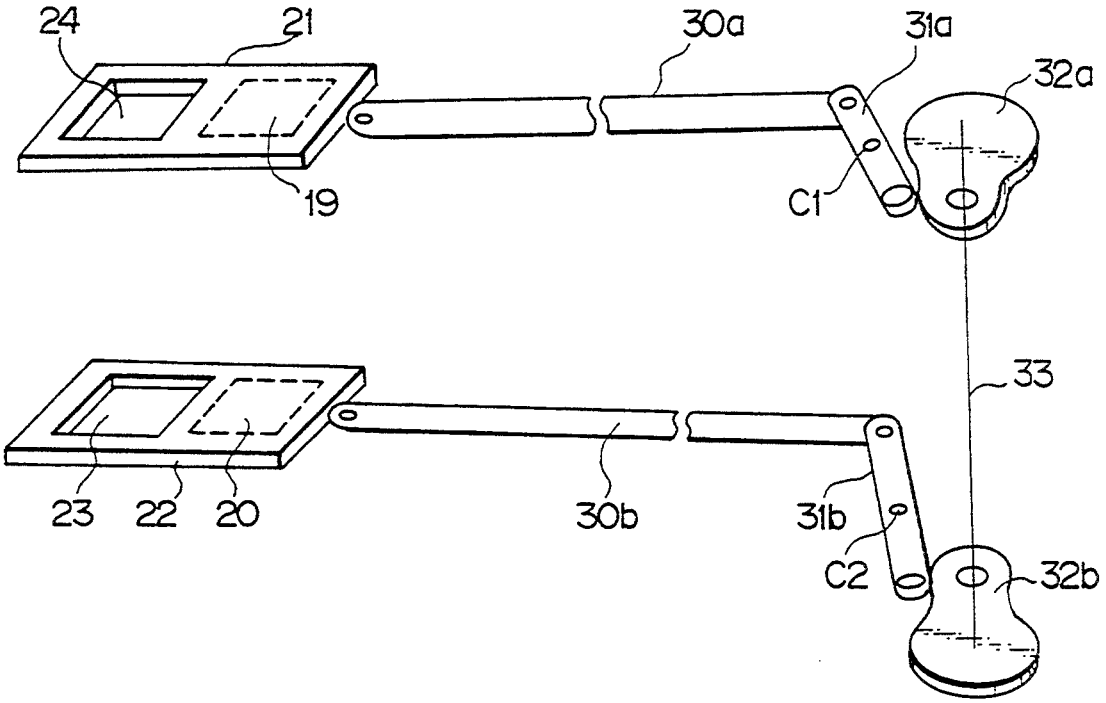
FIGS. 10A, 10B, 10C and 10D illustrate a sequence of shutter operations according to the mechanism shown in FIGS. 7 through 9.
Figure 10B:
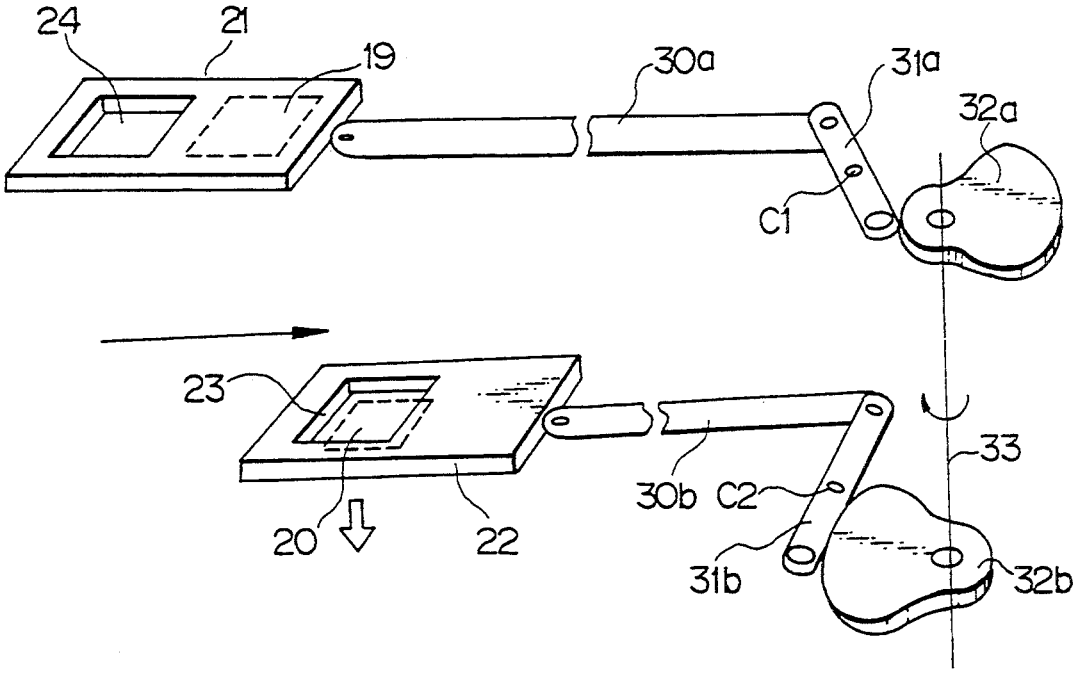
Figure 10C:
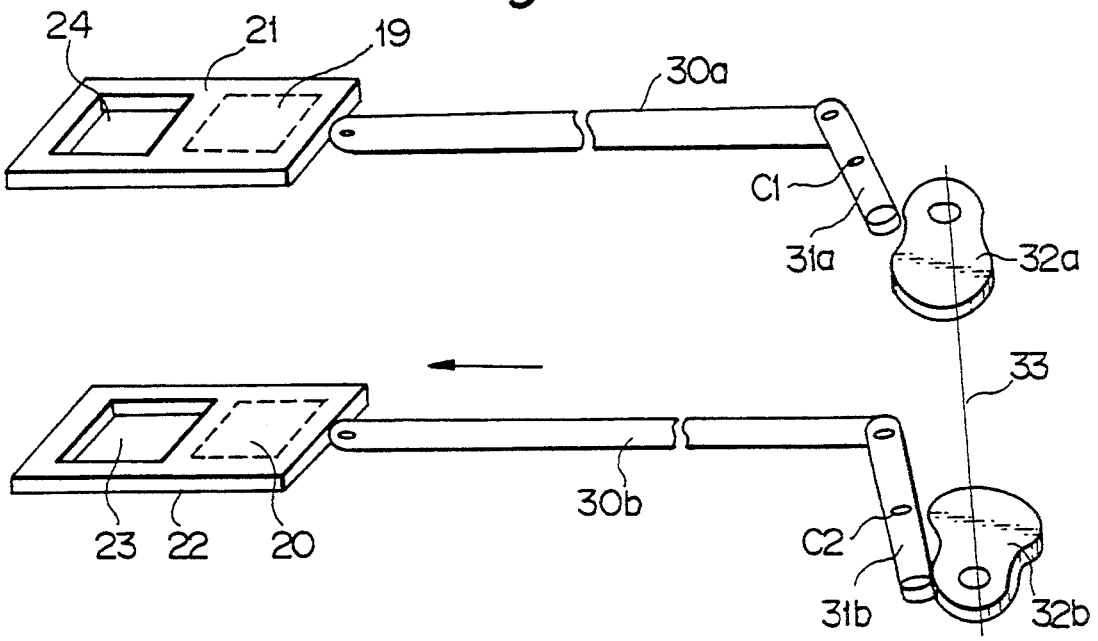

When the cams 32*a*, 32*b* are at the home-position as shown in FIGS. 8 and 9, the cam followers of the cams 32*a*, 32*b* are both positioned in the semicircular portion of the groove 320, and the upper and lower shutters 15, 16 are both in the closed position (see FIG. 10A).

Upon receiving a command to carry out an exchange of developing agent from a control unit (not shown), the motor 35 rotates to drive the shaft 33 clockwise by 90°, but the cam follower of the first lever 31*a* of the upper shutter 15 remains in the semicircular portion, whereby the upper shutter 15 is maintained in the closed position. Further, the cam follower of the first lever 31*b* of the lower shutter 16 is in the arcuate portion, whereby the lower shutter 22 is pulled in the arrowed direction shown in FIG. 10B by the second lever 30*b* and occupies an open position at which the aperture 23 thereof is aligned with the exit port 20 of the container 2. At this stage, the old developing agent is discharged from the container 2.

As the shaft 33 is made to further rotate clockwise to a 180° angular phase, the upper shutter 21 remains in the closed position because the engagement of the cam follower with the semicircular portion of the groove 320 continues. The lower shutter 22 however, is displaced in the arrowed direction in FIG. 10C and resumes a closed position, whereby the discharge of the old developing agent is finished.

Figure 10D:
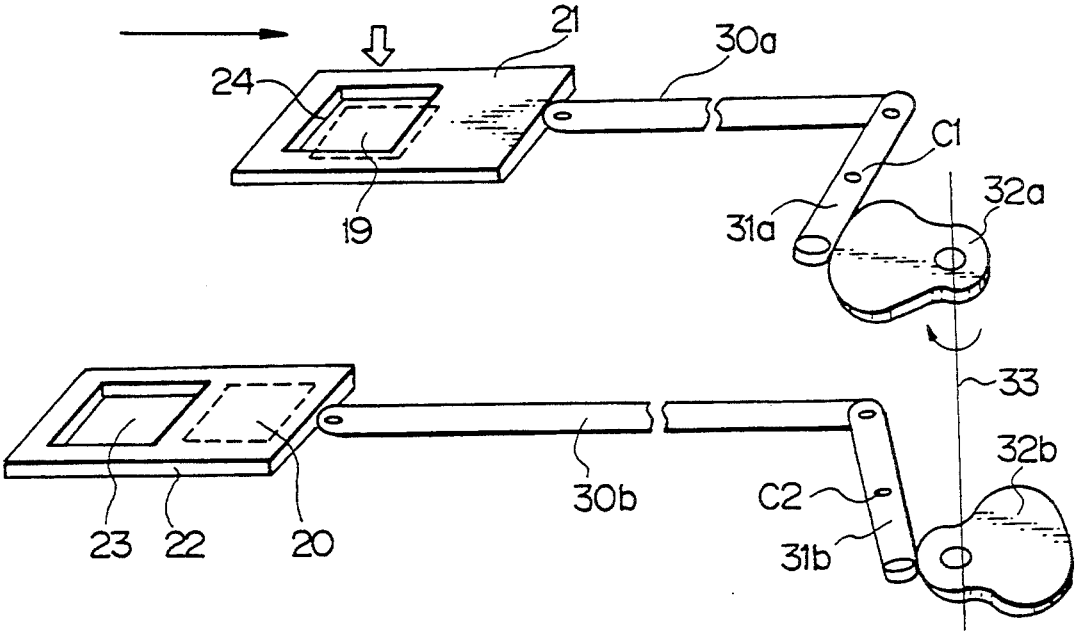

Next, as the shaft 33 is made to further rotate clockwise to the 270° angular phase, the upper shutter 21 is pulled in the arrowed direction in FIG. 10D and occupies an open position at which the aperture 24 thereof is aligned with the inlet port 19 of the container 2. At this stage, the fresh developing agent in the cartridge is transferred into the container 2, while the lower shutter 22 remains closed.

After the shaft 33 has made one complete rotation, the cams 32*a*, 32*b* both resume the home position and the shutters 21, 22 both return to the closed position shown in FIG. 10A. Then the micro-switch 36 outputs a signal to the control unit (not shown) to stop the motor 35.

Usually, as the discharge and replenishment operations of the developing agent take approximately 30 seconds, respectively, the operational speed of the mechanism is controlled so that the open position of the shutters 15, 16 is maintained during this period by properly selecting a gear ratio of the gear train 34*a*, 34*b*, 34*c* or a motor speed.

As stated above, according to this mechanism, an exchange of the old developing agent with reserved fresh agent can be automatically performed with one rotation of the shaft 33.

We claim:

1. A method for exchanging a carrier in a container having a first opening at the upper side of the container and a second opening at the lower side of the container, in which an electrostatic latent image on an image bearing member is developed by a toner with the aid of a carrier, each accommodated in a container, in an image forming apparatus, the method comprising steps of:

providing a cartridge, an upper chamber of said cartridge disposed above the container, and a lower chamber of said cartridge disposed below said container, in which said upper chamber has a toner compartment for containing fresh toner and a carrier compartment for containing fresh carrier, and each of said toner compartment and said carrier compartment and said lower chamber having an opening;

discharging all of an old mixture of toner and carrier from said container to said lower chamber by providing a first communicating path between the second opening of said container and the opening of said lower chamber;

closing said first communicating path;

transferring fresh carrier from the carrier compartment into the container by providing a second communicating path between the opening of said carrier compartment and the first opening of said container; and supplying fresh toner from said toner compartment into said container while measuring color density of a mixture in said container until the mixture in said container has a predetermined color density.

2. A method for exchanging a carrier in a container having a first opening at the upper side of the container and a second opening at the lower side of the container, in which an electrostatic latent image on an image bearing member is developed by a toner with the aid of a carrier, each accommodated in a container, in an image forming apparatus, the method comprising steps of:

providing a cartridge, an upper chamber of said cartridge disposed above said container, and a lower chamber of said cartridge disposed below said container, in which said upper chamber has a toner compartment for containing fresh toner and a mixture compartment for containing a fresh mixture of toner and carrier, and each of said toner compartment and said mixture compartment and said lower chamber having an opening;

discharging part of an old mixture of toner and carrier from said container to said lower chamber by providing a first communicating path between the second opening of said container and the opening of said lower chamber;

closing said first communicating path;

transferring an amount of fresh toner from said toner compartment into said container while measuring color density of a mixture in said container until the mixture in said container has a predetermined color density by providing a second communicating path between the opening of said toner compartment and the first opening of said container; and supplying part of the fresh mixture of toner and carrier, corresponding to the discharged amount of the old mixture, from said mixture compartment into said container, by providing a third communicating path between the opening of said mixture compartment and the first opening of said container.

3. A method for exchanging a carrier in a container having a first opening at the upper side of the container and a second opening at the lower side of the container, in which an electrostatic latent image on an image bearing member is developed by a two component developer comprised of a toner and a carrier, each accommodated in a vessel, a toner density of the two component developer being controlled to a predetermined level, in an image forming apparatus, the method comprising steps of:

providing a cartridge, an upper chamber of said cartridge disposed above said container, and a lower chamber of said cartridge disposed below said container, in which said upper chamber has a fresh mixture of toner and carrier in which a toner density of the fresh mixture is higher than the predetermined level, each of said upper chamber and lower chamber having an opening;

transferring an amount of fresh mixture from said upper chamber into said container by providing a first communicating path between the opening of said upper chamber and the first opening of said container; and discharging part of an old mixture of toner and carrier, corresponding to the transferred amount of the fresh mixture, from said container, by providing a second communicating path between the first opening of said container and the opening of said lower chamber.

4. A shutter mechanism used for carrying out the mixture exchanging operation defined by claim 1, comprising:

an upper shutter movable between a closed position at which an interior of said container is shut off from said carrier compartment of said upper chamber of said cartridge and an open position in which an interior of said container is in communication with said carrier compartment; and a lower shutter movable between a closed position at which an interior of said container is shut off from said lower chamber of said cartridge and an open position at which an interior of said container is in communication with said lower chamber;

said upper and lower shutters being associated with each other through a cam system in such a manner that said upper and lower shutters occupy said open position at respective angular cam phases which are different from each other by 180°.

5. A method for exchanging a carrier in claim 1, wherein said discharging step including a step of rotating a screw roller provided in said container.

6. A method for exchanging a carrier in claim 1, wherein said closing step including a step of moving a slidable shutter having an opening to position the opening of the slidable shutter to a position away from the second opening of said container.

7. A method for exchanging a carrier in claim 1, wherein said supplying step including step of:

rotating a replenishing roller provided in said image-forming apparatus at the first communicating path, and monitoring a color density of a developing agent including the carrier and toner in said container.

8. A method for exchanging a carrier in claim 2, wherein said discharging step including a step of rotating a screw roller provided in said container.

9. A method for exchanging a carrier in claim 2, wherein said closing step including a step of moving a slidable shutter having an opening to position the ,opening of the slidable shutter to a position away from the second opening of said container.

10. A method for exchanging a carrier In claim 2, wherein said transferring step including steps of:

positioning an opening of a slidable shutter to a position opposite to the opening of said mixture compartment of said upper chamber, rotating a replenishing roller provided in said image-forming apparatus at the first communicating path to transfer the fresh mixture of carrier and toner from said mixture compartment into said container, and positioning the opening of the slidable shutter to a position away from the opening of said mixture compartment of said upper chamber.

11. A method for exchanging a carrier in claim 2, wherein said supplying step including steps of:

positioning an opening of a slidable shutter to a position opposite to the opening of said toner compartment of said upper chamber, and rotating a replenishing roller provided in said image-forming apparatus at the first communicating path to supply the fresh toner from said toner compartment in to said container.

12. An image-forming apparatus, comprising:

an image bearing member for conveying an electrostatic latent image;

means for developing the latent image on said image bearing member by a developing agent including a mixture of toner and carrier, said developing means including a vessel having openings;

a cartridge having an upper chamber including a carrier compartment for containing fresh carrier and a toner compartment for containing fresh toner, a lower chamber for receiving the developing agent from the vessel through one of the openings, and means for feeding the carrier into said vessel through another one of the openings and an opening provided in said cartridge; and means for detecting an amount of the developing agent in the vessel and controlling an amount of the carrier supplied to the vessel.

13. An image-forming apparatus in claim 12, wherein said developing means including a pair of screws for mixing the toner and the carrier in the vessel, whereby the developing agent in the vessel is discharged into the lower chamber by rotation of the pair of screws.

14. An image-forming apparatus, comprising:

an image bearing member for conveying an electrostatic latent image;

means for developing the latent image on said image bearing member by a mixture of toner and carrier in a vessel; and a cartridge having an upper chamber including a mixture compartment for containing a fresh mixture of toner and carrier, a toner compartment for containing fresh toner, and first feeding means for feeding the fresh mixture into the vessel, and a lower chamber for receiving the mixture of toner and carrier from the opening of the vessel.

15. An image-forming apparatus, comprising:

an image bearing member for conveying an electrostatic latent image;

means for developing the latent image on said image bearing member by a mixture of toner and carrier in a vessel, the vessel having an opening at the upper side of the vessel, and a cartridge having an upper chamber for containing a developing agent and a lower chamber for receiving the mixture of toner and carrier from the opening of the vessel;

wherein said upper chamber of said cartridge further including:

a toner compartment for containing fresh toner, and a carrier compartment for containing fresh carrier.

16. An image-forming apparatus in claim 14, wherein said developing means including a pair of screws for mixing the toner and the carrier in the vessel, whereby the developing agent in the vessel is discharged into the lower chamber by rotation of the pair of screws.

17. An image-forming apparatus, comprising:

an image bearing member for conveying an electrostatic latent image;

means for developing the latent image on said image bearing member by use of a mixture of toner and carrier in a vessel, and a cartridge having an upper chamber including a mixture compartment for containing a fresh mixture of toner and carrier and first feeding means for feeding the fresh mixture into the vessel, and said cartridge having a lower chamber for receiving the mixture of toner and carrier from the opening of said vessel;

wherein the upper chamber of said cartridge includes a toner compartment for containing fresh toner; and wherein the toner compartment of said upper chamber of said cartridge includes second feeding means for feeding fresh toner from said toner compartment into said vessel.

18. An image forming apparatus as claimed in claim 15, wherein said cartridge further comprises feeding means for feeding the fresh toner from the toner compartment into the vessel.

19. An image forming apparatus as claimed in claim 15, wherein said cartridge further comprises first feeding means for feeding the fresh toner from the toner compartment into the vessel; and second feeding means for feeding the fresh carrier from the carrier compartment into the vessel.

20. An image forming apparatus, comprising:

an image bearing member for conveying an electrostatic latent image;

means for developing the latent image on said image bearing member by a developing agent including a mixture of toner and carrier, said developing means including a vessel having openings;

a cartridge having a carrier compartment for containing fresh carrier, a lower chamber for receiving the developing agent from the vessel through one of the openings, and means for feeding the carrier into said vessel through another one of the openings and an opening provided in said cartridge; said cartridge further including a toner compartment for containing a fresh toner; and shutter means capable of selectively occupying a first position where both the carrier compartment and the toner compartment are closed, a second position where only the carrier compartment communicates with the vessel, and a third position where only the toner compartment communicates with the vessel.

21. An image forming apparatus as claimed in claim 15, further comprising shutter means capable of selectively occupying a first position where both the carrier compartment and the toner compartment are closed, a second position where only the carrier compartment communicates with the vessel, and a third position where only the toner compartment communicates with the vessel.

22. An image forming apparatus, comprising:

an image bearing member for conveying an electrostatic latent image;

means for developing the latent image on said image bearing member by a mixture of toner and carrier in a vessel;

a cartridge having an upper chamber including a mixture compartment for containing a fresh mixture of toner and carrier and first feeding means for feeding the fresh mixture into the vessel, and a lower chamber for receiving the mixture of toner and carrier from the opening of the vessel, said upper chamber of said cartridge including a toner compartment for containing fresh toner; and shutter means capable of selectively occupying a first position where both said mixture compartment and said toner compartment are closed, a second position where only said mixture compartment communicates with said vessel, and a third position where only said toner compartment communicates with said vessel.

23. An image forming apparatus, comprising:

an image bearing member for conveying an electrostatic latent image;

means for developing the latent image on said image bearing member by use of a mixture of toner and carrier in a vessel;

a cartridge having an upper chamber including a mixture compartment for containing a fresh mixture of toner and carrier and first feeding means for feeding the fresh mixture into the vessel, and said cartridge having a lower chamber for receiving the mixture of toner and carrier from the opening of said vessel;

wherein the upper chamber of said cartridge includes a toner compartment for containing fresh toner; and wherein the toner compartment of said upper chamber of said cartridge includes second feeding means for feeding fresh toner from said toner compartment into said vessel; and shutter means capable of selectively occupying a first position where both the carrier compartment and the toner compartment are closed, a second position where only the carrier compartment communicates with the vessel, and a third position where only the toner compartment communicates with the vessel.

24. An cartridge detachably mounted to an image forming apparatus comprising an image bearing member for conveying an electrostatic latent image and developing means for developing the latent image on said image bearing member by a developing agent having a mixture of toner and carrier in a vessel, said cartridge comprising:

a developer compartment for containing developing agent;

a first feeding means for feeding the developing agent from the developer compartment into the vessel;

a toner compartment for containing fresh toner;

second feeding means for feeding the toner from the toner compartment into the vessel; and a lower chamber for receiving the developing agent from the vessel.

25. An image forming apparatus as claimed in claim 24, wherein the developing agent is a mixture of toner and carrier.

26. A method for exchanging a carrier in a container having a first opening at the upper side of the container and a second opening at the lower side of the container, in which an electrostatic latent image on an image bearing member is developed by a two component developer comprised of a toner and a carrier, each accommodated in a vessel, in an image forming apparatus, the method comprising the steps of:

providing a cartridge, an upper chamber of said cartridge disposed above said container, and a lower chamber of said cartridge disposed below said container, in which said upper chamber has a mixture compartment for containing a fresh mixture of toner and carrier and a toner compartment for containing a fresh toner, each of the mixture compartment, the toner compartment and the lower chamber having an opening;

discharging an old mixture of toner and carrier in the vessel to the lower chamber by providing a second communicating path between the first opening of said container and the opening of said lower chamber;

closing the second communicating path;

transferring an amount of fresh mixture from said upper chamber into said container by providing a first communicating path between the opening of the mixture compartment and the first opening of said container; and supplying fresh toner from the toner compartment into the container after the transferring step.

27. A cartridge attachable to and detachable from an image forming apparatus including a vessel accommodating two component developer including a toner and a carrier, the vessel having openings, one of which is provided at upper portion of the vessel and another of which is provided at lower portion of the vessel, comprising:

an upper chamber disposed above the vessel, the upper chamber including a mixture compartment for containing a fresh mixture of toner and carrier, and a toner compartment for containing fresh toner, the mixture compartment having an opening and the toner compartment having an opening, the fresh mixture in the mixture compartment being supplied through the opening of the mixture compartment and the opening of the upper portion into the vessel and the fresh toner in the toner compartment being supplied through the opening of the toner compartment and the opening of the upper portion into the vessel; and a lower chamber disposed below the vessel and having an opening, for receiving the mixture of toner and carrier through the opening of the lower chamber and the opening of the lower portion of the vessel.

28. A cartridge according to claim 27, wherein the upper chamber further comprises a first feeding means for feeding the fresh toner from the toner compartment to the vessel.

29. A cartridge according to claim 27, wherein the upper chamber further comprises a second feeding means for feeding the fresh mixture from the mixture compartment to the vessel.

30. A cartridge according to claim 27, wherein the upper chamber further comprises a first shutter means for opening and closing the openings of the toner compartment and the mixture compartment.

31. A cartridge according to claim 27, wherein the lower chamber further comprises second shutter means for opening and closing the opening of the lower chamber.

32. A cartridge attachable to and detachable from an image forming apparatus including a vessel accommodating a two component developer including a toner and a carrier, the vessel having openings, one of which is provided at an upper portion of the vessel and another of which is provided at a lower portion of the vessel comprising:

an upper chamber disposed above the vessel, the upper chamber including a carrier compartment for containing fresh carrier, and a toner compartment for containing fresh toner, the carrier compartment having an opening and the toner compartment having an opening, the fresh carrier in the carrier compartment being supplied through the opening of the carrier compartment and the opening of the upper portion into the vessel and the fresh toner in the toner compartment being supplied through the opening of the toner compartment and the opening of the upper portion into the vessel; and a lower chamber disposed below the vessel and having an opening, for receiving an old two component developer in the vessel through the opening of the lower portion of the vessel and the opening of the lower chamber.

33. A cartridge according to claim 32, wherein the upper chamber further comprises a first feeding means for feeding the fresh toner from the toner compartment to the vessel.

34. A cartridge according to claim 32, wherein the upper chamber further comprises second feeding means for feeding the fresh carrier from the carrier compartment to the vessel.

35. A cartridge according to claim 32, wherein the upper chamber further comprises first shutter means for opening and closing the openings of the toner compartment and the carrier compartment.

36. A cartridge according to claim 32, wherein the lower chamber further comprises second shutter means for opening and closing the opening of the lower chamber.

* * * * *